US006481704B1

(12) United States Patent
Koster et al.

(10) Patent No.: US 6,481,704 B1
(45) Date of Patent: Nov. 19, 2002

(54) SETTING AN APPARATUS FOR ASSEMBLING MAIL ITEMS

(75) Inventors: Bert Koster, Drachten; Herman Sytema, Terhorne, both of (NL)

(73) Assignee: Neopost B.V., Drachten (NL)

( * ) Notice: Subject to any disclaimer, the term of this patent is extended or adjusted under 35 U.S.C. 154(b) by 8 days.

(21) Appl. No.: 09/664,582

(22) Filed: Sep. 18, 2000

(30) Foreign Application Priority Data

Sep. 17, 2000 (NL) ..... 1013084

(51) Int. Cl.[7] ..... B65H 39/642

(52) U.S. Cl. ..... 270/58.23; 270/52.02; 270/58.02; 270/56; 271/9.11; 271/9.13

(58) Field of Search ..... 271/9.01, 251.01, 271/9.11, 9.13, 3.03; 270/58.02, 58.03, 52.02, 58.23, 58.24, 58.25, 58.26, 56

(56) References Cited

U.S. PATENT DOCUMENTS

| | | | | | |
|---|---|---|---|---|---|
| 2,821,384 | A | * | 1/1958 | Mendes | 270/58.25 |
| 3,175,821 | A | * | 3/1965 | Gibson | 270/58.29 |
| 3,350,089 | A | * | 10/1967 | Niccoli | 270/58.01 |
| 3,536,318 | A | * | 10/1970 | Gay et al. | 270/58.11 |
| 3,887,176 | A | * | 6/1975 | Paulus et al. | 270/58.18 |
| 3,966,186 | A | | 6/1976 | Helm | |
| 3,972,521 | A | | 8/1976 | Reed | |
| 4,625,954 | A | * | 12/1986 | Pusey | 270/58.03 |
| 4,982,013 | A | | 1/1991 | Gubelmann et al. | |
| 5,039,077 | A | * | 8/1991 | Gunther, Jr. | 270/52.02 |
| 5,125,635 | A | * | 6/1992 | Iwabuchi | 270/56 |
| 5,280,895 | A | * | 1/1994 | Meier | 270/58.03 |
| 5,362,037 | A | | 11/1994 | van der Werff et al. | |
| 5,499,806 | A | * | 3/1996 | Bourg | 271/105 |
| 5,503,380 | A | * | 4/1996 | Hidding | 270/58.02 |
| 5,556,086 | A | * | 9/1996 | Munneke et al. | 270/58.02 |
| 6,152,439 | A | * | 11/2000 | Hirayama et al. | 270/52.01 |
| 6,341,934 | B1 | * | 1/2002 | Takeno et al. | 270/58.23 |

FOREIGN PATENT DOCUMENTS

| | | |
|---|---|---|
| EP | 556922 | 8/1993 |
| EP | 781671 | 7/1997 |
| FR | 2619366 | 2/1989 |
| GB | 1443124 | 7/1976 |
| JP | 2001072323 A * | 3/2001 |

* cited by examiner

*Primary Examiner*—Christopher P. Ellis
*Assistant Examiner*—Patrick Mackey
(74) *Attorney, Agent, or Firm*—Burns, Doane, Swecker & Mathis, LLP

(57) ABSTRACT

In determining a setting condition of an apparatus for assembling mail items from mail components (20, 21, 23, 25) it is detected, in a setting phase, in which of a number of feeder stations (1, 2, 34, 35) of that apparatus mail components (20, 21, 23, 25) are present. Feeder stations (1, 2, 34, 35) in which mail components are present are automatically brought into an operating condition, and feeder stations (1, 2, 34, 35) in which no mail components are present are automatically brought into a non-operating condition. As a result, at the start-up of the apparatus, on the basis of the loading thereof, it is automatically determined which station is to be brought into an operating condition and which are to remain standby. An apparatus specifically arranged for practicing the proposed method is also described.

11 Claims, 1 Drawing Sheet

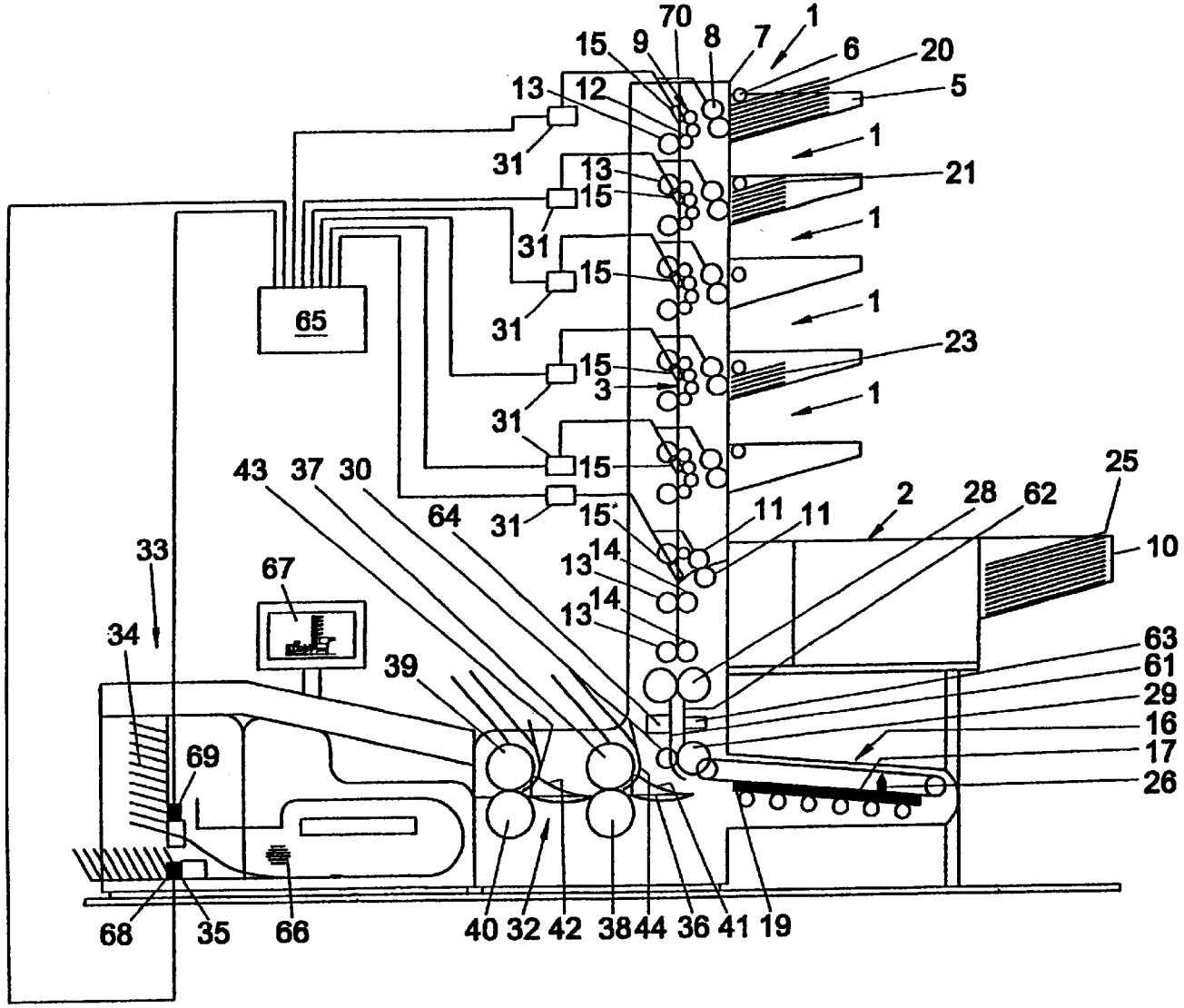
1
20
5
6
7
8
70
9
15
12
13
21
23
25
10
2
28
62
11
11
63
61
29
16
17
26
19
41
36
44
38
42
32
40
39
64
30
37
43
31
3
14
65
67
66
69
35
33
34
68

SETTING AN APPARATUS FOR ASSEMBLING MAIL ITEMS

BACKGROUND OF THE INVENTION

This invention relates to a method for determining a setting condition of an apparatus for assembling mail items from mail components, and to an apparatus for assembling mail items from mail components.

Such a method and such an apparatus are known from European patent specification 0 556 922. In that specification, it is proposed to feed and scan a number of documents prior to starting a run. Data regarding these documents, such as length and identification, as obtained in scanning, can be stored. These data can subsequently be used in controlling the system, for instance for actuating selected feeder stations for feeding one or more documents contained therein, or for setting a folding station. In particular, it can be determined which insert documents are located in which feeder stations. These feeder stations can then be actuated, when assembling the mail items, depending on indicia on the main documents, which indicia indicate what insert documents are to be added. Accordingly, in that case, the system itself determines which feeder stations are to be actuated during that run in order for the correct insert documents to be added to a main document.

A drawback of this system is that the setting of the system must be set prior to a run or job, so as to indicate which feeder stations are to be used during that run. If this not done and, for instance, all feeder stations are on, 'error' reports or 'empty' reports will be generated for the unfilled units, because no documents will have been placed in those units.

More common in practice, for that matter, are systems in which each mail item has the same composition, which is determined by the selection of feeder stations which have been turned on. Such systems also present the problem that the operator of the apparatus must specify which feeder stations are to be used during a particular job or run, because otherwise undesirable 'error' reports or 'empty' reports will be generated. In response to such reports, systems generally switch to a standby mode which is not left until operational interventions have been detected in the system, such as opening a valve or filling a tray.

SUMMARY OF THE INVENTION

It is an object of the invention to provide a solution with which activities which are to be carried out prior to the execution of a job or run in a mail assembly system with a plurality of feeder stations which are not all of them to be used all the time, can be limited and simplified.

According to the present invention, this object is achieved by providing a method for determining a setting condition of an apparatus for assembling mail items from mail components, comprising detecting, in a setting phase, in which of a number of feeder stations mail components are present, while in response to the detection, during the setting phase, of at least one mail component in at least one specimen of the feeder stations in the setting condition determined by the apparatus, that at least one specimen of the feeder stations is in operating condition, and in response to the non-detection, during the setting phase, of the presence of at least one mail component in another specimen of the feeder stations, the other specimen of the feeder stations is in non-operating condition.

The invention further provides an apparatus for assembling mail items from mail components, comprising a number of feeder stations for feeding mail components to be processed into mail items, means for detecting actual data regarding mail components loaded into feeder stations of the system, a control unit for determining, in response to the actual data, at least one setting of the system, detection means coupled to the control unit for detecting in a setting phase in which of the feeder stations mail components are present, while in the setting condition of the system, at least one specimen of the feeder stations is in operating condition in response to the detected presence of at least one mail component in the at least one feeder station, and, in response to the non-detection of the presence of at least one mail component in another specimen of the feeder stations, this other specimen of the feeder stations is in non-operating condition. Such an apparatus is specifically adapted for carrying out the proposed method.

As the determination of whether a feeder station is to be brought into an operating condition or non-operating condition is done automatically, depending on the detection, or non-detection, in a setting phase, in which of the feeder stations mail components are present, and subsequently, in an operating phase, exclusively feeder stations that are in operating condition are controlled for activation, then exclusively those feeder stations in which mail components are present are brought into an operating condition, without the operator needing to determine which feeder stations are to be active or non-active. By ensuring prior to a run or job that the mail components to be processed, such as documents, inserts and envelopes in which these are to be packaged are placed in the different feeder stations, it is thus automatically accomplished that only the filled, and hence useable, feeder stations are operatively controlled for feeding documents. It can also be provided that only that system setting condition or those system setting conditions is or are proposed to the operator that fit the configuration of loaded and non-loaded feeder stations. The actual bringing into the operating condition, or non-operating condition, of the feeder stations is then done after confirmation of a selection of a system setting condition by the user.

Further objects, aspects, effects and details of the invention are described below with reference to an exemplary embodiment presently preferred most, represented in the drawing.

BRIEF DESCRIPTION OF THE DRAWINGS

The drawing is a cutaway diagrammatic side elevation of a system according to an exemplary embodiment of the invention.

DETAILED DESCRIPTION

The system represented in the drawing is equipped with a number of feeder stations in the form of document feeder stations 1 for feeding documents 20, 21, 23, a printer 2 for printing sheets 25 and feeding thus obtained documents, and envelope feeder stations 34, 35 for feeding envelopes.

The first four feeder stations are designed as document feeder stations 1. Each of the document feeder stations 1 comprises a magazine 5, a supply roller 6, a separation roller 7, a transport roller 8 and a pair of feed rollers 9. An example of a separation facility suitable for use in a document feeder station 1 according to the exemplary embodiment shown is described in more detail in U.S. Pat. No. 5,362,037, which is hereby referred to.

The printer 2 comprises a magazine 10 for sheets to be printed and a pair of feed rollers 11 for feeding a printed sheet at a suitable moment. The printer 2 is further so designed that printing a sheet is each time completed before the sheet reaches a waiting position between the feed rollers 11.

The feeder stations 1, 2 are connected to a feed track 3 having a series of opposed transport rollers 12, 13, 14.

The apparatus shown further comprises an aligning station 16 for aligning documents associated with a particular set, into a stack having on one side substantially aligned document edges.

The aligning station is designed as a head station having an aligning surface 19 with a stop 26 and a discharge track 36 in line with the aligning surface 19. Upstream of the aligning surface, the aligning station 16 has transport rollers 27, 28, 29, 30, and guides 61, 62, and the aligning surface 19 is formed by a portion of a conveyor belt 17 passing over a support.

The documents can be transported in a feeding direction against the stop 26 and subsequently be discharged in opposite direction to a folding station 32. The aligned document edges then form the trailing edge of the stack, which is advantageous in folding the stack.

Provided opposite the aligning surface 19 is a conveyor belt 17, which runs approximately parallel to the aligning surface 19, can exert some pressure on the aligning surface 19 and has a greater coefficient of friction with respect to documents than does the aligning surface 17 which moreover is provided with rollers for further limiting the friction between documents and that surface. By driving the belt 17 in the direction of the stop 26, documents present between the aligning surface 19 and the belt 17 can be urged against the stop 26, so that the document edges on the side of the stop 26 are mutually aligned.

The aligning surface 19 is convexly curved in the direction of movement of the stop 26. Due to the tension of the circulating belt 17 of the press-on means, the belt 17, in an area contiguous to the stop 26, exerts a uniformly distributed pressure in the direction of the aligning surface 19.

By driving the conveyor belt 17, a document can be moved over the surface 19 against the stop 26. A next document, which has been passed partly between the preceding document and the conveyor belt 17, will slide over the preceding document, likewise against the stop 26, when the belt 17 is driven in the direction of the stop 26. Thus, successive documents can be aligned.

The folding station 32 is provided with a first and a second pair of folding rollers 37, 38 and 39, 40, with the discharge track 36 passing between the folding rollers 37, 38 and 39, 40. Between the stop 26 and the folding rollers 37, 38 and 39, 40, respectively, deflectors 41 and 42 are arranged for deflecting the edge of a stack located remote from the stop 26. Opposite a folding nip between each pair of folding rollers 37, 38 and 39, 40, a folding knife 43, 44 is arranged for pressing a deflected portion of a document or a stack of document into the folding nip.

After alignment of the documents of a stack in the aligning station 16, it is first moved against the feeding direction and then to the folding station 32. In the process, at least if the stack is to be folded, the edge of the stack remote from the stop 26 and a contiguous portion of the stack are deflected along a pair of folding rollers 37, 38 or 39, 40 and the stack is then pressed into a folding nip between the folding rollers 37, 38 or 39, 40 by one of the folding knives 43, 44. Then the folding rollers are driven, so that a fold is provided in the stack.

A folding station and folding method of the type as described hereinbefore is described in more detail in U.S. Pat. No. 4,985,013, which is hereby referred to.

Connected to the folding station 32 is an inserter station 33. This inserter station 33 is equipped with two magazines 34, 35 for envelopes. As a basis for such an inserter station can serve an inserter station which is described in more detail in European patent application publication no. 0,781,671. The inserter station has an envelope track 4 and an exit 18 for packaged mail items.

In assembling a mail item utilizing a system according to the exemplary embodiment shown, the feeder stations 1, 2 feed documents to the transport track 3. The documents are aligned by the aligning station 16 into a stack on one side having substantially aligned document edges. This stack is fed to the folding station 32 in a direction transverse to the edges mentioned.

For scanning fed documents, downstream of the feeder stations 1, 2 and upstream of the aligning station 16, scanning means for scanning a passing document to be gathered are arranged. According to the present exemplary embodiment, the scanning means are designed as a light source 63 and a photosensitive cell 64. By also scanning the rotation of one of the transport rollers 27–30, for instance the length of a passing document can be measured.

The above means 27–30, 63 and 64 for measuring the length of a passing document to be gathered can be connected with a data processor for inputting and storing a signal corresponding to the measured length in that data processor. This signal in turn can be used, for instance, as input datum for setting the folding station 32 in order to determine the number of folds, and the position and the folding direction, such that the documents fit with a particular play into a given envelope.

The scanning means can also comprise a scanner for scanning indicia present on the documents, which scanner is connected with a data processor. These indicia can consist, for instance, of coded processing instructions on a main document. The data processor can, on the basis of the scanned indicia, control the other stations of the system, for instance for activating the proper feeder stations 1, 2 for adding the correct documents, setting the folding station 32, and selecting the proper envelope tray 34, 35 for feeding an envelope.

The scanning means can further comprise a thickness meter for measuring the thickness of a passing document to be gathered, which thickness meter is connected with a data processor for inputting a signal corresponding to the measured thickness into that data processor. The signal corresponding to the measured thickness can be compared with a reference signal to verify whether a single document has been fed and is being transported, or an error has occurred and no document or more than one document has been fed and is being transported. When documents have mutually different thicknesses, it can further be verified whether the correct document has been fed and is being transported.

Prior to the start of a run or a job, a number of documents can be fed, with each fed document being individually transported and scanned downstream of the feeder stations. Data regarding these documents, such as length and identification, as obtained in scanning, can be stored. These data can subsequently be used in controlling the system, for instance for controlling selected feeder stations for feeding one or more documents located therein or for setting the folding station 32.

More particularly, for instance, it can be determined which insert documents are located in which feeder stations. In assembling the mail items, these feeder stations can then be controlled depending on indicia on the main documents, which indicia indicate which insert documents are to be added. Accordingly, the system itself then determines which feeder stations are to be controlled in order for the correct insert documents to be added to a main document. Neither the operator of the system nor the person responsible for the determination of which insert document is to be added to which main document needs to be concerned with this.

Further, main documents can be individually transported and scanned downstream of the feeder stations, so that in each indicia on the main document can be scanned. The information obtained upon scanning the indicia can be used for controlling the system.

In order to determine which document is located in a feeder station, it is possible, in scanning, to scan indicia of a passing secondary document, and to store a document code corresponding to the scanning result in a data processor in association with a feeder station code belonging to the feeder station by which the scanned document has been fed.

Instead, when scanning a particular passing secondary document, at least a portion of that document can be optically scanned, and a brightness pattern thereby obtained can be stored in a memory in association with an associated document code. Further, in scanning a passing next secondary document, at least a portion of that next document can be optically scanned, whereafter a brightness pattern thereby obtained is compared with the brightness pattern stored in association with the associated document code.

In this way, it can be established which insert document is located in a feeder station, without the insert document needing to be provided with indicia.

The scanning of secondary documents for obtaining a brightness pattern can be carried out with the same reading head 64 as the scanning of indicia of a main document, which indicia represent, for instance, operating instructions concerning a mail item to be assembled, with which that main document is associated. In that case, no special separate scanner for scanning brightness patterns of secondary documents is needed.

It is also possible to scan the length and the thickness of a document and to store a document code corresponding to the scanning result in a data processor in association with a feeder station code associated with the feeder station by which the scanned document has been fed. When a next document is fed by that feeder station, it can be checked, on the basis of the scanned length and thickness thereof, whether that document agrees with the first document fed by that feeder station.

The data regarding the length of a document can further be used for determining the distance over which that document is displaced, substantially against the feeding direction, until the trailing edge thereof has been brought outside the feed track. What is prevented by bringing the trailing edge of a document fed to the aligning station 16 outside the feeding track is that a next fed document which is to be added to the above-mentioned document abuts against the edge of that above-mentioned document remote from the stop 26.

The displacement substantially against the feeding direction can be obtained in the apparatus according to the exemplary embodiment represented in the drawing, by causing the conveyor belt 17 to move along the aligning surface 19 in the direction of the folding station 32. The previously trailing portion of the fed documents will subsequently pass under the guide 61, so that this is not displaced back in the direction of the feeder stations 1 and 2, but is displaced outside of the portion of the transport track coming from those stations 1 and 2. A next document which is passed along the guide 61 will link up with the document having arrived last, spaced from the trailing edge thereof, and hence not butt against that formerly trailing edge of that document.

The feeder stations 1, 2 are each provided with a detector 15 just upstream of the point where the feeding track of the respective feeder station 1, 2 links up with the transport track 3. These detectors 15 are each coupled to a control unit 31 of the respective feeder station 1, 2 which control units 31 in their turn are coupled with a central control unit 65. The control units 31 are each further coupled via a connection 70 with controls of the drive (not shown) in order to enable a separated and fed mail component to be stopped in a waiting position. From this waiting position, it can be fed upon command (command coming from the central control unit).

The control unit 65 is accommodated in the inserter station 33, but, for the sake of clarity, is represented outside of this inserter station 33. For the purpose of detecting, in a setting phase, in which of said feeder stations mail components are present, the control unit 65 controls the control units 31 of the feeder stations 1 for them to feed a document. If thereupon within a particular time interval of, for instance, 1 s, a document is detected in the waiting position by the associated one of the detectors 15, the feeder station is registered as being loaded. If within the respective time interval this detector 15 does not detect a document, the respective feeder station 1 is registered as being empty.

In the example represented in the drawing, (counting from the top down) the first, second and fourth feeder stations 1 and the printer 2 contain documents or sheets, respectively, and the third and the fifth feeder station are empty. Accordingly, the first, second and fourth feeder station 1 and the printer 2 are registered as being loaded and the third and fifth feeder station are registered as being empty, because in response to a command to bring a document into the waiting position, after the expiry of the time interval available for that purpose, no document was detected in the waiting position. The control unit 1 is further arranged for bringing into operating condition the feeder stations 1 which have been registered as being filled—i.e., in this example, the first, second and fourth feeder station 1 and the printer 2—and for bringing into a non-operating condition the feeder stations 1 which have been registered as being empty—i.e., in this example, the third and fifth feeder station 1—, and for subsequently, in an operating phase, controlling for activation exclusively the feeder stations 1 which are in operating condition.

It is also possible, for that matter, that the control unit, in response to a particularly detected loading pattern of the feeder stations 1, 2, does not bring the feeder stations directly into an operating condition or non-operating condition, but first proposes one or more system setting conditions, which may or may not have been pre-inputted by the user or as service setting condition, which are not applied until the selection of them is confirmed by the operator of the system. Such system setting conditions can contain, in addition to the operating and non-operating condition of the different feeder stations 1, 2, 34, 35, other settings as well, such as selection of the envelope feeder station, automatic switch between two or more feeder stations when one or more of them are empty, selective or non-selective insert addition depending on indicia read or on data coming from an external source, etc.

The magazines of the envelope feeder stations 34, 35 are provided with detectors 68, 69 which can detect when a particular minimum quantity of envelopes has been reached.

Of the envelope feeder stations 34, 35, only the feeder station 34, 35 is brought into an operating condition, in respect of which the control unit 65 has registered that the associated detector 68, 69 has detected the presence of a minimum amount of documents.

By detecting in a setting phase in which of the feeder stations 1, 2, 34, 35 mail components are present, and automatically bringing into an operating condition only those feeder stations 1, 2, 34, 35 which have been registered as being filled, the necessity of setting the system as regards the feeder stations 1 which are active in operating condition is eliminated. Thus, at start-up, the system itself determines which of the feeder stations must be active in operation and which are to be left in or brought into a different condition, such as a waiting position.

Because for detecting the presence of mail components in the feeder stations 1, detectors 15 for detecting mail components in positions downstream of the feeder stations 1 are used, which detectors 15 are coupled to the control unit 65 and indicate whether in response to an activation of a feeder station a mail component is passing, at start-up of the system, also the operation of the feeder stations 1 is tested. The risk of improper operation of the system after start-up is thereby considerably reduced.

In the operating phase of the system, signals indicating that a specimen of the feeder stations 1 is empty are generated only if absence of a mail component in a specimen of the feeder stations is detected in combination with the respective specimen of the feeder stations 1 being in operating condition. Thus, 'empty' reports regarding feeder stations 1 which have been set out of operations are prevented. For generating 'empty' signals, the system comprises a buzzer 66 which produces a signal that can also be perceived if the attention of persons present in the neighborhood of the system is not focused on the system.

It is also possible, for that matter, to use a different, greater minimum number or a greater amount of mail components as a criterion for generating the 'empty' signal. This provides the advantage that an 'empty' signal, or in fact 'refill' signal, is generated before the respective magazine is empty. This principle is used in the feeder stations 34, 35 and is of particular advantage therefor, because upon depletion of a magazine of envelopes, it is often impossible to switch to supply from the other one of the envelope feeder stations 34, 35 (which contains envelopes of a different kind) and hence the system comes to a halt.

In order to signal to the operator which of the feeder stations 1, 2, 34, 35 are in operating condition, the system comprises signaling means in the form of a display 67 for signaling in a human-perceptible form which of the feeder stations 1, 2, 34, 35 are in operating condition. It is also possible to provide the feeder stations 1 with indicators, so that at start-up it can be very easily verified whether all feeder stations with filled magazine are in operating condition.

The control unit 65 is further arranged for automatically determining standard (default) system settings depending on whether different ones of the feeder stations 1, 2, 34, 35 are in operating condition. If the lowermost of the feeder stations 1 is in operating condition, the system is automatically set for the selective supply of inserts from the other feeder stations and the printer 2 in accordance with optical indicia detected by the scanner 64. These standard setting conditions, for that matter, can be manually modified, inter alia by opting for predetermined sets of job settings.

It will be clear from the foregoing, to those skilled in the art, that within the framework of the invention, many other embodiments and variants are possible other than the examples described. Thus, it is possible, for instance, that the control unit transmits control signals to feeder stations not in the operating condition, but that these do not result in a document being fed, and that in that case also 'magazine empty' signals are suppressed or are provided with an addition so that they do not have the consequences of normal 'magazine empty' signals. The invention is also applicable to systems for assembling mail items that work according to the principle whereby inserts are annexed when other components of a mail item pass along the respective feeder stations.

We claim:

1. A method for determining a setting condition of an apparatus for assembling mail items from mail components, wherein the apparatus includes a number of feeder stations, the method comprising detecting, in a setting phase, in which of the feeder stations the mail components are present, in response to detecting during said setting phase the presence of at least one mail component in at least one of said feeder stations, in the setting condition determined by the apparatus, said at least one of said feeder stations is in an operating condition, and in response to not detecting during said setting phase the presence of at least one of the mail components in another of said feeder stations, said another of said feeder stations is in a non-operating condition.

2. A method according to claim 1, further comprising:

generating, in an operating phase of said apparatus, signals indicating that one of said feeder stations is empty or is becoming empty, in response to, in combination: detection of the absence of at least a minimum of one mail component in said one feeder station and said one feeder station being in the operating condition.

3. A method according to claim 1, wherein the detection of the presence of a mail component in the at least one of said feeder stations comprises:

controlling said at least one of said feeder stations for feeding a mail component and subsequently detecting downstream of said at least one of said mail feeder stations whether the mail component passes.

4. A method according to claim 1, further comprising:

the step of signaling in human-perceptible form which of said feeder stations are in the operating condition.

5. A method according to claim 1, further comprising:

selecting at least one further setting, depending on the at least one of said feeder stations being in the operating condition.

6. An apparatus for assembling mail items from mail components, comprising:

a number of feeder stations for feeding mail components to be processed into mail items, means for detecting actual data regarding the mail components loaded into the feeder stations of the apparatus, a control unit for determining, in response to said actual data, at least one setting of the apparatus, detection means coupled with said control unit for detecting in a setting phase in which of said feeder stations the mail components are present, wherein in said setting condition of the apparatus at least one of said feeder stations is in an operating condition in response to the detected presence of at least one mail component in said at least one of said feeder stations, and, in response to a non-detection of the presence of at least one of the mail components in another of said feeder stations, said another of said feeder stations is in a non-operating condition.

7. An apparatus according to claim 6, further comprising:

a detector for detecting mail components in a position downstream of at least one of said feeder stations, which detector is coupled with said control unit, the control unit being arranged for controlling one of said feeder stations for feeding a mail component and subsequently detecting downstream of said one controlled feeder station whether a mail component passes, and generating mail component present signal if subsequently a detection signal is received from said detector and generating a mail component absent signal if subsequently within a particular time interval no detection signal is received from said detector.

8. An apparatus according to claim 6, further comprising:

signaling means for signaling in human-perceptible form which of said feeder stations are in the operating condition.

9. An apparatus according to claim 6, wherein said control unit is arranged for determining at least one further setting depending on said at least one of said feeder stations being in the operating condition.

10. An apparatus according to claim 9, wherein said feeder stations are arranged for feeding different sizes of the mail components.

11. An apparatus according to claim 10, wherein said feeder stations are envelope feeder stations.

* * * * *